US008468948B2

(12) United States Patent
Delmonico et al.

(10) Patent No.: US 8,468,948 B2
(45) Date of Patent: Jun. 25, 2013

(54) RAILROAD TIE PLATE HANDLING MACHINE

(76) Inventors: Doug Delmonico, Broomfield, CO (US); Fabian Weber, Boulder, CO (US)

( * ) Notice: Subject to any disclaimer, the term of this patent is extended or adjusted under 35 U.S.C. 154(b) by 202 days.

(21) Appl. No.: 13/081,110

(22) Filed: Apr. 6, 2011

(65) Prior Publication Data

US 2011/0239893 A1 Oct. 6, 2011

Related U.S. Application Data

(60) Provisional application No. 61/321,354, filed on Apr. 6, 2010.

(51) Int. Cl.
*E01B 29/32* (2006.01)

(52) U.S. Cl.
USPC ..... 104/16; 104/2

(58) Field of Classification Search
USPC ..... 104/2, 5, 6, 7.1, 7.2, 9, 16, 242, 243, 104/245, 309
See application file for complete search history.

(56) References Cited

U.S. PATENT DOCUMENTS

| | | | | |
|---|---|---|---|---|
| 160,462 | A | | 3/1875 | Palmer |
| 2,730,962 | A | | 1/1956 | Wright et al. |
| 3,423,858 | A | | 1/1969 | Speno |
| 3,943,858 | A | | 3/1976 | Dieringer et al. |
| 4,241,663 | A | | 12/1980 | Lund et al. |
| 4,274,334 | A | | 6/1981 | Lund |
| 4,301,738 | A | | 11/1981 | Theurer et al. |
| 4,305,336 | A | * | 12/1981 | Hunsberger et al. ..... 105/215.1 |
| 4,393,784 | A | | 7/1983 | Theurer et al. |
| 4,691,639 | A | | 9/1987 | Holley |
| 4,907,686 | A | | 3/1990 | Cotic |
| 4,942,822 | A | | 7/1990 | Cotic |
| 4,974,518 | A | | 12/1990 | Cotic et al. |
| 5,063,856 | A | * | 11/1991 | Theurer et al. ..... 104/9 |
| 5,067,412 | A | | 11/1991 | Theurer et al. |
| 5,142,987 | A | | 9/1992 | Freymuth et al. |
| 5,331,899 | A | | 7/1994 | Holley |
| 5,435,251 | A | | 7/1995 | Clark et al. |
| 5,487,341 | A | | 1/1996 | Newman et al. |
| 5,577,447 | A | | 11/1996 | Weber et al. |
| 5,596,254 | A | | 1/1997 | Vaughn et al. |
| 5,617,795 | A | | 4/1997 | Glomski et al. |
| 5,655,455 | A | | 8/1997 | Smith |
| 5,671,679 | A | | 9/1997 | Straub et al. |
| 5,722,325 | A | | 3/1998 | Glomski et al. |
| 5,730,060 | A | | 3/1998 | Straub et al. |
| 5,915,744 | A | | 6/1999 | Cotsford |
| 6,131,272 | A | | 10/2000 | Girouard et al. |
| 6,647,891 | B2 | | 11/2003 | Holmes et al. |
| 6,755,135 | B2 | | 6/2004 | Johnsen et al. |
| 6,863,717 | B2 | | 3/2005 | Johnsen et al. |
| 7,104,200 | B2 | | 9/2006 | Hosking et al. |
| 7,437,997 | B2 | | 10/2008 | Herzog et al. |
| 7,497,166 | B2 | | 3/2009 | Fuerst et al. |

(Continued)

*Primary Examiner* — S. Joseph Morano
*Assistant Examiner* — Zachary Kuhfuss

(57) ABSTRACT

A tie plate handling device for use in connection with removing and replacing railroad tie plates from a track during a rail change-out process. The tie plate handling device provides operator lift assistance and certain embodiments provide for a fully automated lift and movement of railroad tie plates. The tie plate handling device comprises a lifting arm, an engaging unit for securely coupling with a tie plate and a control unit for operating the same. Methods for using the tie plate handling device in conjunction with the rail change-out process are also described.

11 Claims, 10 Drawing Sheets

U.S. PATENT DOCUMENTS

| | | | |
|---|---|---|---|
| 2002/0078853 | A1 | 6/2002 | Holmes et al. |
| 2003/0005850 | A1 | 1/2003 | Johnsen et al. |
| 2003/0183116 | A1 | 10/2003 | Johnsen et al. |
| 2007/0283837 | A1 | 12/2007 | Brenny et al. |
| 2009/0133598 | A1 | 5/2009 | Coots |
| 2009/0145324 | A1 | 6/2009 | Delmonico |

* cited by examiner

RAILROAD TIE PLATE HANDLING MACHINE

This application claims the benefit of U.S. Provisional Application No. 61/321,354, filed Apr. 6, 2010, which is hereby incorporated by reference in its entirety.

BACKGROUND OF THE INVENTION

The modern railway consists of steel rails secured on top of railway sleepers or cross-ties. The conventional material for cross-ties is wood. When wooden cross-ties are employed, tie plates are used distribute the load and to secure the steel rails to the cross-ties. The tie plates are made of either cast or forged steel and comprise a generally flat steel plate with a substantially flat bottom, a plurality of spike or lag holes located on opposite side ends of the plate, and an upper surface having a pair of parallel, vertically projecting rail securing ribs which define a cradle area or rail seat there between in which the rail is placed. The tie plate upper surface in the rail bearing area is slightly angled to provide an inwardly canted rail seat, with more mass located on the field side of the plate to compensate for the force distribution of the load associated with a train moving along the rail and counteract cross-tie bending moment caused thereby. The rail is secured to the tie plate and cross-tie by various fasteners including spikes and clips intended for that purpose.

Due to normal wear and tear, from time to time railways require regular maintenance and reconditioning to ensure, among other things, that the proper gauge spacing between the steel rails is maintained. Wide gauge can be caused over time by wear to the steel rails. When rails are to be replaced because of wear or otherwise, they are typically replaced one side at a time in quarter mile long sections known as strings. The cross-ties are then resurfaced, or adzed, and the rail bed (i.e. the surface of the cross-ties in the rail bearing area) is refurbished. Before the rail bearing area of the cross-tie can be resurfaced, the associated spikes and tie plates must first be removed. Similarly, prior to new rails being laid, replacement or recycled tie plates must be accurately positioned back upon the ties.

Tie plate replacement is a labor-intensive and cumbersome process. This is due to the significant weight of the individual plates (between about 20-35 lbs. each), the number of tie plates laid in any one section of track being refurbished (wooden cross-ties are placed at 19.5 inch on center intervals, nominally), and the rapid rate at which the tie plates must be manually positioned to keep up with the other operations of track reconditioning, the majority of which are automated. If the tie plates are to be reused, typically each individual tie plate is manually removed from its working position on the cross-tie in the rail bearing area and transferred to either side of the track (usually the field side). This is conventionally accomplished by one or more workers walking along the track with hooks or other manual devices designed for such purpose. Thereafter, once the cross-ties have been adzed, or resurfaced, a worker then must retrieve the steel tie plates individually and properly orient each tie plate for setting upon the upper surface of a cross-tie to form new rail beds. Accurate tie plate placement is critical, and there is not much room for error. Accordingly, reconditioning even a small section of a railway equates to a worker manually moving several tons of weight both out and back into the tie plate's working position after the requisite adzing, resurfacing and other related work to the cross-ties has been completed.

Often times, existing tie plates are replaced with new plates. In this case, prior to the rail changing process; a gondola car having a large electromagnet is used to distribute piles of a dozen or more tie plates at regular intervals along side of the track. Thereafter, workers manually stage the new tie plates next to each of the cross-ties. Once the rail has been cut and fasteners removed, the worn rail is removed via a work crane (also known as a speed swing) which is also equipped with an electromagnet that magnetically collects the old tie plates from the track and deposits them in piles next to the track for collection. The cross-ties are then resurfaced, the new plates are manually positioned and the replacement rail is placed. Once all of the components are properly aligned, the new plates and rail are secured to the cross-ties.

Regardless of whether the tie plates are reused or replaced, railway maintenance requires that a significant number of steel tie plates are moved manually by one or more workers. Considering the relatively rapid rates of placement required, as well as the degree of accuracy required, operator effort and safety become major concerns.

SUMMARY OF THE INVENTION

Devices and methods for handling railroad tie plates are disclosed. In at least one embodiment, a device for handling railroad tie plates comprises a base, a lifting arm having a proximal end and a distal end, a lifting unit for moving the distal end of the lifting arm vertically relative to the base, a tie plate engaging unit rotatably coupled with the distal end of the lifting arm and adapted to releasably couple with a tie plate, a rotary unit for rotating the engaging unit, and a control unit. The proximal end of the lifting arm is coupled with the base and the distal end of the lifting arm is moveable vertically relative to the base. The control unit is in communication with the lifting unit, rotary unit and engaging unit, for operating the lifting arm to move the distal end of the lifting arm vertically relative to the base, operating the rotary unit to rotate the engaging unit, and operating the engaging unit to couple with or release a tie plate.

The lifting unit of the device may be positioned at the proximal end of the lifting arm and/or may be selected from a group consisting of a hydraulic cylinder, a pneumatic cylinder, a linear electric motor, an air lift cylinder, mechanical springs, and counter weights. In at least one additional embodiment, the lifting unit may comprise an encoder adapted to collect and convey data regarding magnitude of a load lifted by the lifting arm and a rod clamp for locking the vertical position of the lifting arm.

The base of the device for handling railroad tie plates may be configured to mount to a moveable frame. In at least one embodiment, the base comprises a pedestal component configured to mount to a moveable frame and an extension component comprising a proximal end connected to the pedestal component and a distal end.

The tie plate engaging unit of the device may be selected from a group consisting of an electromagnet, a vacuum and a clamp. In at least one embodiment, the tie plate engaging unit comprises about a 440 pound force continuous duty electromagnet. Additionally or alternatively, the tie plate engaging unit may comprise a linear axis. In at least one embodiment, the rotary unit of the device is adapted to rotate the engaging unit about ±135° around the linear axis.

In at least one embodiment, the tie plate engaging unit may additionally comprise a pivot component having at least one joint adapted to accept bending or angulation in any plane. For example and without limitation, the pivot component may comprise a twin axis gimbal joint. Further, the engaging unit may further comprise a lost motion device adapted to prevent the release of the tie plate therefrom unless and until the tie plate is in contact with a surface. Similarly, the incorporation of a lost motion device such that overtravel is required to activate the engaging unit to couple with a tie plate would reduce instances where there is less than full contact between the engaging unit and the tie plate, and reduce the risk of inadvertently dropping the tie plate and possible injury to the operator.

The control unit of the device may comprise a signal or data processor. Additionally or alternatively, the control unit may be adapted to direct the speed and motion of a moveable frame to which the base is mounted. In the at least one embodiment where the base is mounted to a moveable frame, the control unit may further comprise one or more photoelectric sensors positioned adjacent to each of the one or more joysticks and adapted to prevent movement of the moveable frame when activated.

In at least one embodiment, the control unit comprises one or more joysticks adapted to operate the tie plate engaging unit, the rotary unit, the lifting arm and control the motion and speed of the moveable frame. Optionally, at least a portion of the control unit may be remote from the lifting arm and the tie plate engaging unit. In at least one embodiment, the tie plate engaging unit may further comprise one or more sensors for collecting data and each of the sensors may be adapted to transmit the collected data to the remote portion of the control unit. Such data may include information used for accurate placement of the tie plate on the tie, such as the position and orientation of the engaging unit and/or the distribution of the weight of the tie plate coupled to the engaging unit. In yet another embodiment, the sensors may be incorporated in a camera system for sensing the outline of the tie plate. Further, the control unit may additionally comprise a processor adapted to process the collected data to achieve a value and direct operation of the lifting assembly and the engaging unit pursuant to the value.

DETAILED DESCRIPTION OF THE INVENTION

Figure 1A:
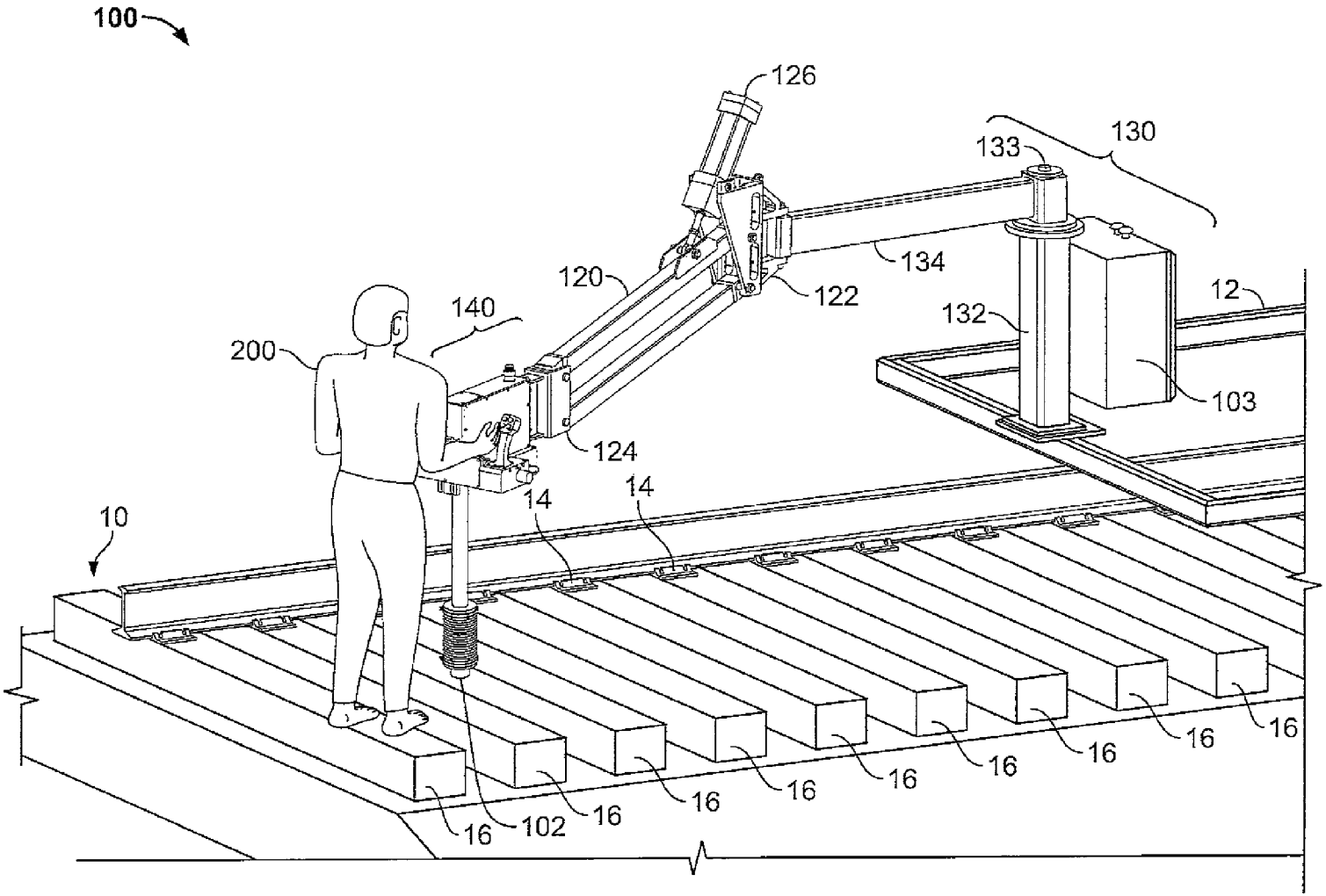
FIG. 1A shows a side view of at least one embodiment of a tie plate handling device being operated by a user.

Reference will now be made to various embodiments and the drawings, and specific language will be used to describe the same. It will nevertheless be understood that no limitation of scope is intended by the description of these embodiments. Similarly, with respect to the drawings, it will be appreciated that like reference characters designate like elements.

FIG. 1A shows a side view of a tie plate handling device 100 adapted to provide an operator lift assistance with respect to moving and manipulating tie plates 14. In at least one embodiment, the tie plate handling device 100 comprises a tie plate engaging unit 102, a lifting arm 120, a base 130 and a control unit 140. In operation, the tie plate handling device 100 provides an ergonomic solution for a human operator to easily engage a tie plate 14 with the tie plate engaging unit 102 of the tie plate handling device 100, and lift and/or move the same with the lifting arm 120 fully supporting the weight.

Figure 1B:
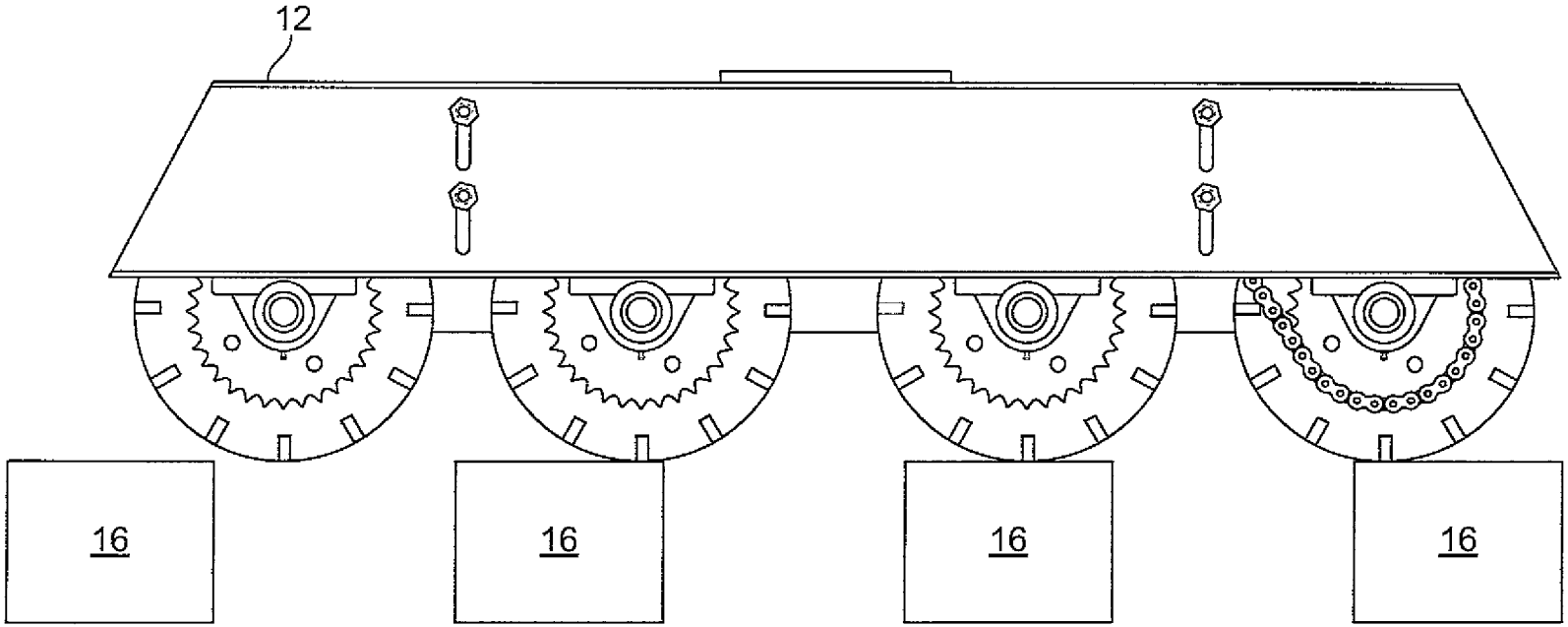
FIG. 1B shows a side view of a mountable frame to which the tie plate handling device of FIG. 1A may be mounted.

The base 130 of the tie plate handling device 100 is designed to be either mounted to a moveable frame 12 (i.e. a work ear) adapted for independent movement or travel along a railway 10 or, alternatively, to a larger railway maintenance machine or other railroad equipment. In at least one embodiment, the base 130 comprises a pedestal component 132 and an extension component 134, and is configured such that the extension component 134 can move in a horizontal fashion across the railway 10. In the at least one embodiment shown in FIG. 1A, the pedestal component 132 and the extension component 134 are pivotally coupled at a joint 133 which is adapted such that the extension component 134 can move in a horizontal fashion relative to the pedestal component 132. Alternatively, the pedestal component 132 and the extension component 134 may be fixed relative to each other or the base 130 may only comprise the pedestal component 132. In the at least one embodiment in FIG. 1A, the entire base 130 of the tie plate handling device 100 is adapted for lateral rotation in a horizontal plane relative to the moveable frame 12 (or other railway maintenance machine to which the tie plate handling device 100 is mounted). FIG. 1B shows a side-view of at least one embodiment of a moveable frame 12 to which the base 130 may be mounted. It will be appreciated that any configuration of the base 130 may be employed provided the extension component 134 of the base 130 is adapted for lateral movement across a railway 10.

In addition to being anchored to the moveable frame 12 or other railway maintenance machine, the base 130 is also coupled with the lifting arm 120 of the tie plate handling device 100. The lifting arm 120 is the component of the tie plate handling device 100 that bears the weight of, and maneuvers, the tie plates. The lifting arm 120 comprises an elongated body having a proximal end 122, a distal end 124 and one or more joints, and is formed of any material adapted for bearing and lifting substantial loads such as steel. For example, the lifting arm 120 must be constructed to support the weight of any live load affixed to the tie plate handling device 100 (i.e. the actual weight of the tie plates themselves), and also the weight of the dead load consisting of the weight of the lifting arm 120 itself.

The proximal end 122 of the lifting arm 120 is connected to the extension component 134 of the base 130, through a joint or otherwise. The joint(s) of the proximal end 122 of the lifting arm 120 allow for movement of the distal end 124 of the lifting arm 120. Irrespective of whether or not the proximal end 122 of the lifting arm 120 is connected to the extension component 134 of the base 130 via a joint, it will be appreciated that the proximal end 122 of the lifting arm 120 may comprise any number and/or types of joints to achieve the appropriate versatility of motion desired, provided at least one of the joints allows for the vertical motion of the distal end 124 of the lifting arm 120. Alternatively, in at least one embodiment, the proximal end 122 of the lifting arm 120 may be connected with the base 130 (either directly or through the extension component 134) such that the proximal end 122 of the lifting arm 120 can move up and down the base 130 in a vertical fashion, thereby allowing for vertical motion of the distal end 124 of the lifting arm 120 without use of a joint.

Figure 2:
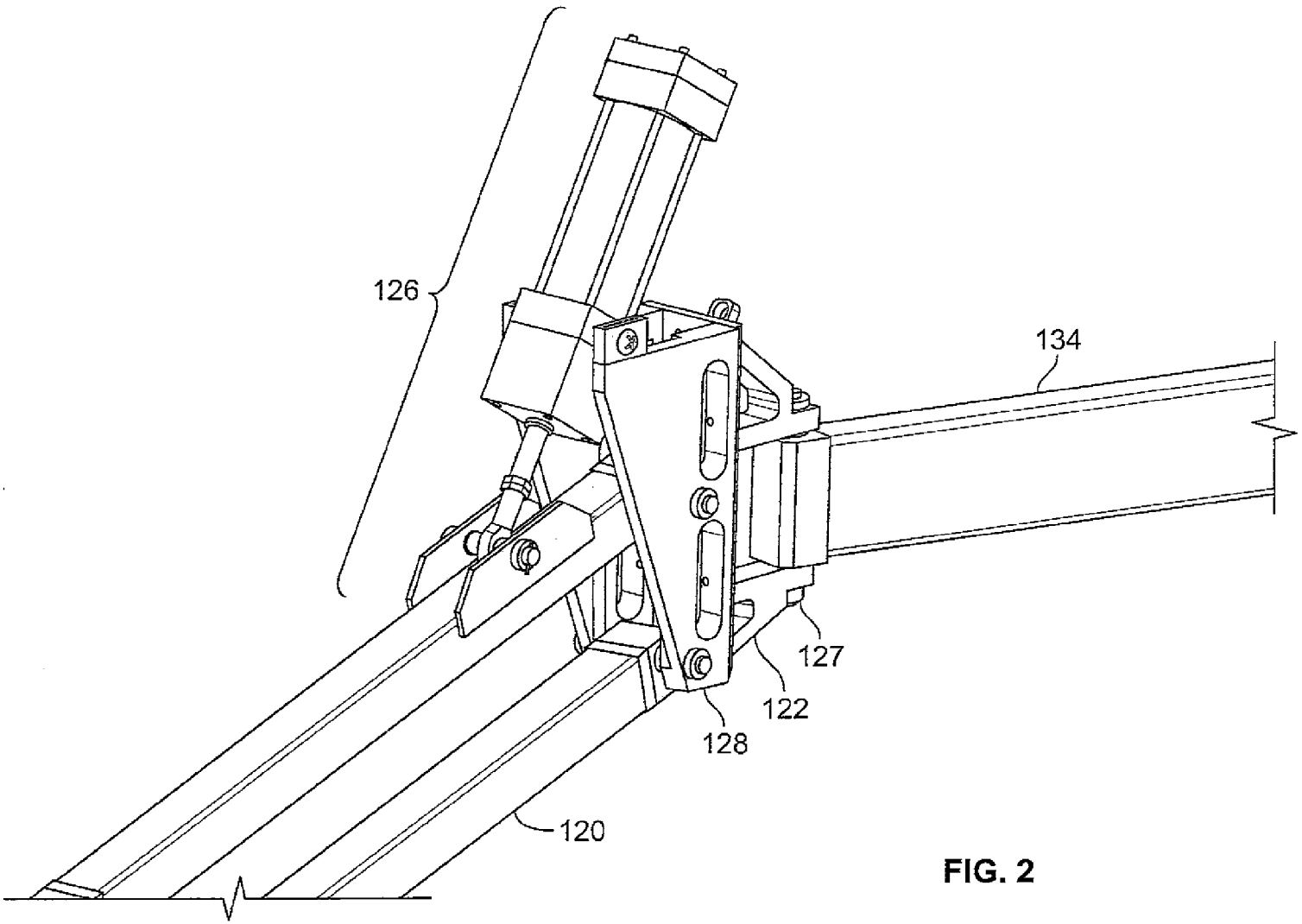
FIG. 2 shows a perspective view of at least one embodiment of a lifting boom and a lifting assembly of the tie plate handling device of FIG. 1A.

FIG. 2 illustrates at least one embodiment of the proximal end 122 of the lifting arm 120. As illustrated in FIG. 2, the proximal end 122 is coupled with the extension component 134 at a first joint 127 and further comprises a second joint 128. In this at least one embodiment, the first joint 127 is configured such that the lifting arm 120 is adapted for lateral movement relative to pedestal component 132 of the base 130. Here, as the extension component 134 of the base 130 is also adapted for lateral movement relative to the pedestal component 132 of the base 130, it will be appreciated that the first joint 127 provides the tie plate handling device 100 additional reach and range of motion along the horizontal plane. The second joint 128 of the proximal end 122 is configured to allow for vertical movement of the distal end 124 of the lifting arm 120 relative to the base 130. Accordingly, in operation the distal end 124 of the lifting arm 120 may be manipulated from side-to-side (i.e. laterally) across the railway 10 through articulation of the first joint 127 and up and down (i.e. vertically) through articulation of the second joint 128. In this manner, the distal end 124 of the lifting arm 120 can be accurately positioned over a rail seat, and thereafter moved up or down to engage and/or lift a tie plate.

The proximal end 122 of the lifting arm 120 further comprises a lifting unit 126. The lifting unit 126 comprises any device or configuration known in the art that is adapted to raise the distal end 124 of the lifting arm 120 relative to the proximal end 122 of the lifting arm 120. For example and without limitation, the lifting unit 126 of the tie plate handling device 100 may comprise a pneumatic or hydraulic cylinder, mechanical springs, counter weights, a linear electric motor, any other means known in the art, or a combination of any of the aforementioned. Accordingly, the lifting unit 126 must not only be capable of supporting the weight of the lifting arm 120 and any tie plate 14 to be moved by the tie plate handling device 100, but it must also be capable of effectively maneuvering the live and dead loads such that the operator can move the mass of the tie plate 14 and conduct any necessary rotation of the same to properly orient the tie plate 14 during its removal and/or replacement back onto the rail bed. In certain embodiments, the lifting unit 126 may be in communication with the control unit 140 (see FIG. 1) such that an operator can operate the lifting unit 126 without maintaining physical contact with the same. The control unit 140 is described in further detail below.

FIG. 2 illustrates at least one embodiment of a lifting unit 126 comprising an air lift cylinder equipped with an encoder and a rod clamp for closed loop positioning. The encoder of the lifting unit 126 may be any encoder known in the art and may be used to collect and convey data regarding the magnitude of load lifted by the lifting arm 120. In at least one embodiment, the data collected by the encoder is used by proportional controls to control the velocity and positioning of the lifting arm 120 in order to create a predetermined lifting velocity and, therefore, maximize operator safety. In addition, the prevention of rapid lifting and dropping motions reduces the stress on and extends the life of the lifting arm 120. Further, the rod clamp may comprise any mechanism adapted to lock the lift position of the lifting arm 120 at a desired height. Accordingly, the rod clamp functions to take pressure off of the lifting unit 126 and bear some or all of the load when the distal end 124 of the lifting arm 120 is held in one position for a period of time. It will be appreciated that inclusion of a rod clamp or similar device with the lifting unit 126 and use thereof in operation provides protection against lifting unit 126 failure and may function to extend the useful life of the lifting unit 126. Additionally, the rod clamp can accurately maintain position of lifting arm 120 with respect to the base 130 when operating work car 12 over rough terrain and cross-ties 16, as well as to accommodate use of a low bulk modulus fluid such as compressed air in the lifting unit 126. A braking system may also be used to stop the free swinging and control the lateral movement of lifting arm 120 when not in use. In yet another embodiment, air brake systems may be incorporated at joints 127 and/or 133, which may be actuated when the lifting arm 120 is not in use, such as by a dead man switch, to prevent the uncontrolled movement of the arm and possible injury to the operator. This feature is of particular use when the equipment is situated on a curved portion of the railway, where the track is commonly banked and gravity might otherwise cause the lifting arm to swing uncontrolled across the track.

As shown in FIG. 1A, the distal end 124 of the lifting arm 120 is further connected to, or coupled with, the control unit 140 and a tie plate engaging unit 102. Now referring to FIG. 3, at least one embodiment of the engaging unit 102 comprises a shaft 104 and is adapted to releasably couple with a tie plate via an electromagnet 108 or other engaging mechanism. The shaft 104 extends between the control unit 140 and the electromagnet 108 and may further comprise a rotary unit (not shown) adapted to rotate the shaft 104 about axis A-A. In at least one embodiment, the rotary unit is adapted to rotate the shaft 104 about ±135° around axis A-A.

The distal end of the shaft 104 of the engaging unit 102 is coupled with the electromagnet 108 such that rotation of the shaft 104 about axis A-A results in like rotation of the electromagnet 108, in this manner, when the electromagnet 108 is securely coupled with a tie plate 14, rotation of the shaft 104 results in rotation of the tie plate 14. The electromagnet 108 of the engaging unit 102 comprises an electromagnet adapted to couple with a tie plate 14 in a removable or releasable, albeit secure, fashion such that the tie plate 14 can be safely and accurately maneuvered by the tie plate handling device 100. In at least one embodiment, the electromagnet 108 comprises about a 440 lb. force continuous duty electromagnet operating at 24 volts DC and consuming approximately 20 watts, such as part number CAE-300-24C available from AEC Magnetics, 4699 Interstate Dr., Cincinnati, Ohio 45246. In a preferred embodiment, electromagnet 108 has a lifting capacity of 2,500 lbs. and has a square or rectangular shape, rather than round. The higher lifting capacity reduces the risk that dirt or rust on the tie plate will interfere with coupling to the engaging unit, and reduces the risk of inadvertently dropping the tie plate when there is less than full engagement with the electromagnet 108. In instances where the tie plate is only coupled to an edge of the electromagnet 108, the use of a rectangular shape electromagnet increases the area of contact in comparison to a round shape. It will be appreciated that other configurations may be employed to releasably couple the tie plate 14 with the tie plate handling device 100. For example and without limitation, instead of the electromagnet 108 shown in FIG. 3, additional embodiments of the tie plate handling device 100 may comprise a vacuum, clamp or other device to releasably grip or couple with the tie plate 14.

Figure 4:
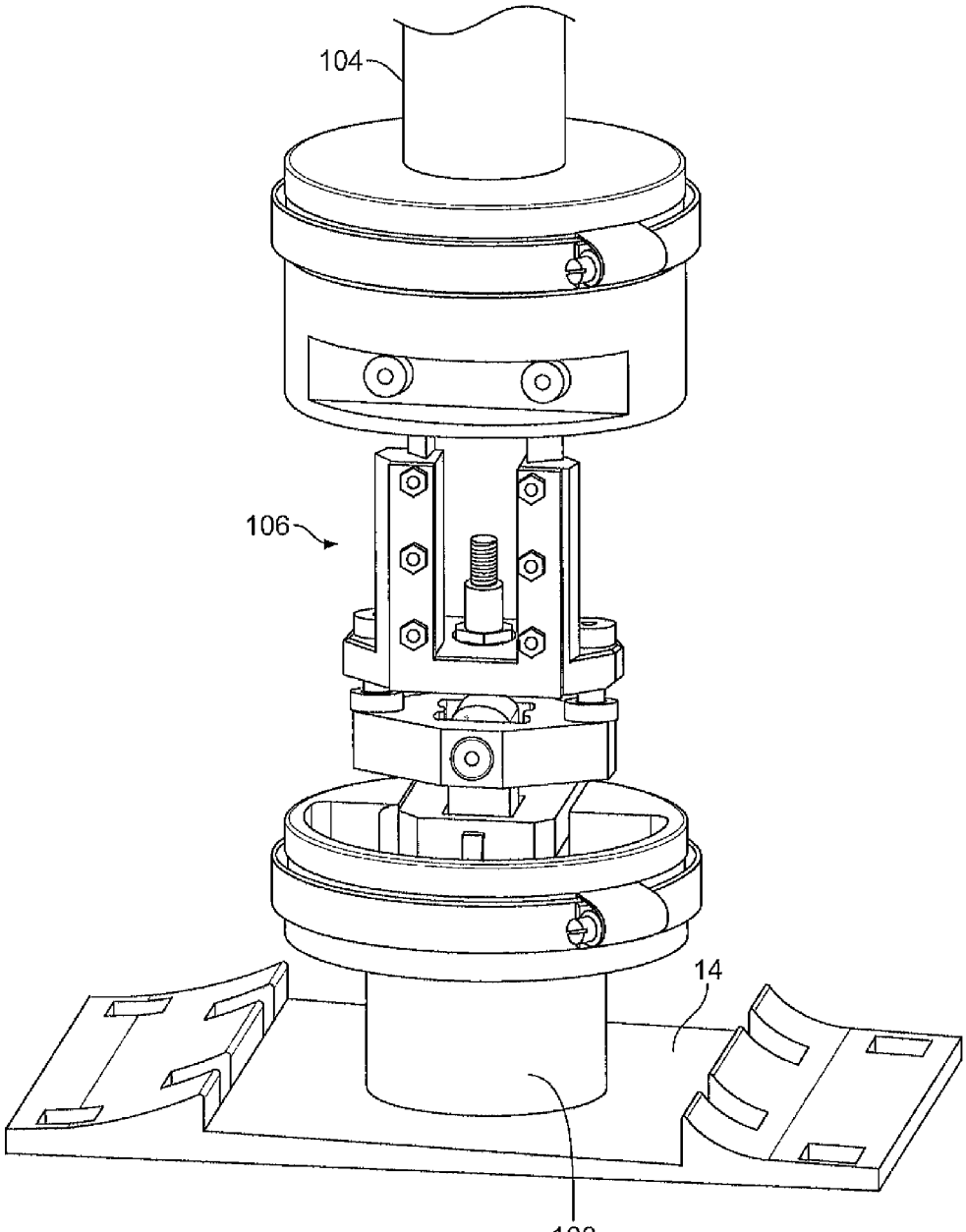
FIG. 4 shows a front view of at least one embodiment of the distal end of the engaging unit of FIG. 3 coupled with a tie plate and with the flexible bellows covering removed.

Now referring to FIG. 4, the distal end of at least one additional embodiment of the engaging unit 102 is shown. Here, the engaging unit 102 is in communication with the control unit 140 (either electrically or remotely) and further comprises a pivot component 106 connected to both the shaft 104 and the electromagnet 108. The pivot component 106 comprises a joint that, instead of being limited to deflection in only one plane, can accept bending or angulation in any plane. In this manner, the pivot component 106 enables the electromagnet 108 of the tie plate handling device 100 to grip tie plates that are located on uneven surfaces. In at least one embodiment, the joint of the pivot component 106 comprises a twin axis gimbal joint.

Figure 3:
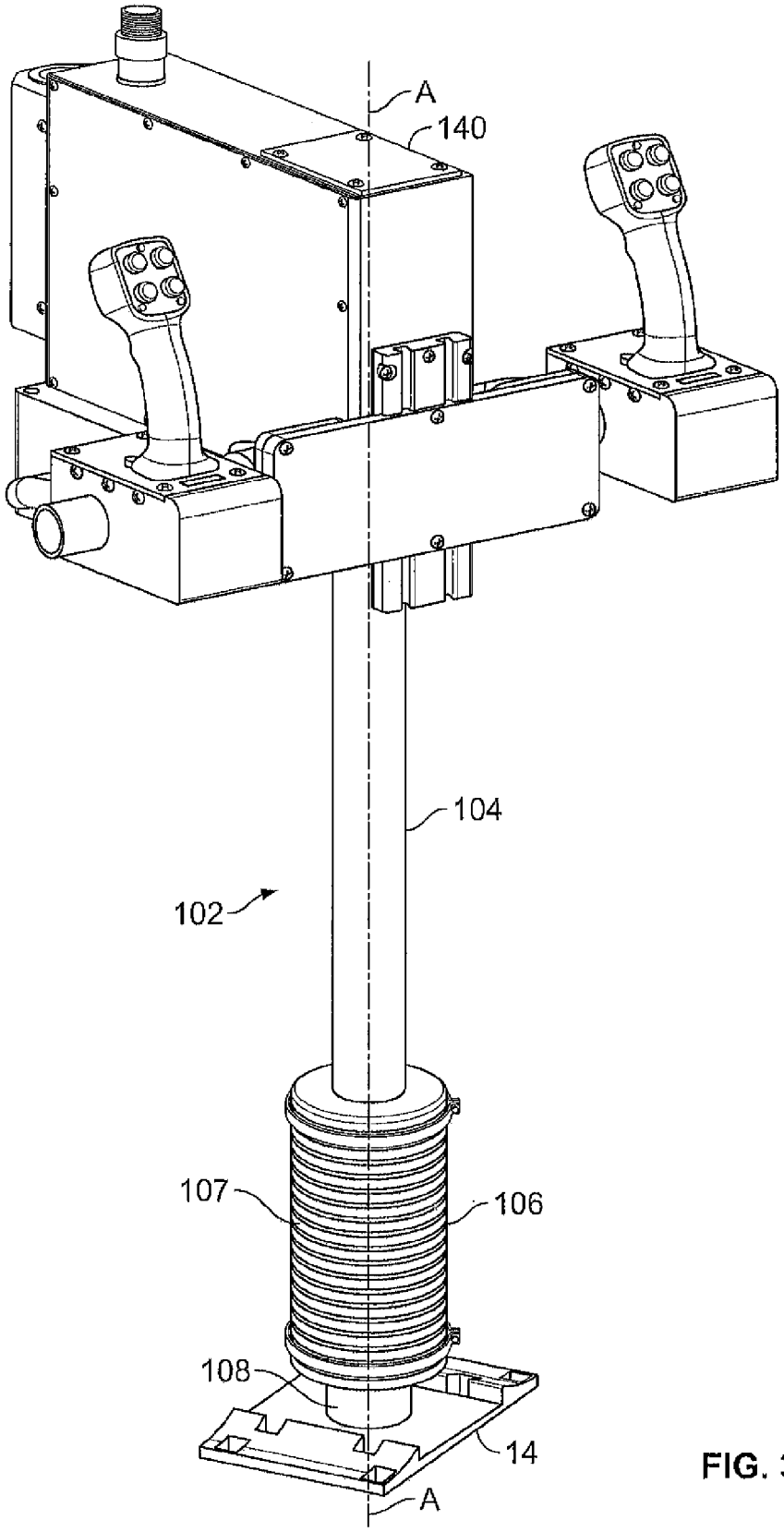
FIG. 3 shows a perspective view of a control unit and an engaging unit of the tie plate handling device of FIG. 1A.

In addition to the joint, the pivot component 106 may further comprise a lost motion, or positive placement, device (not shown) as a safety component. Inclusion of the lost motion device in the pivot component 106 eliminates the risk of a tie plate 14 coupled with the tie plate handling device 100 being released in the air and possibly falling on a worker's foot. As with typical lost motion devices known in the art, the lost motion device prevents the tie plate handling device 100 from disengaging a tie plate 14 coupled therewith, unless the tie plate 14 is first pressed against a surface (i.e. the ground) such that the tie plate handling device 100 can travel an additional distance toward the tie plate 14. As shown in FIGS. 1A and 3, the one or more components of the pivot component 106 may be covered by a flexible bellows covering or any other covering that is sufficient to protect the pivot component 106 during operation of the tie plate handling device 100.

Referring to the embodiment shown in FIG. 1A, the control unit 140 may be mounted on or coupled with the lifting arm 120 and in electrical or remote communication with the engaging unit 102 by way of a master control cabinet 103 mounted in a remote position such as the work car 12. The control unit 140 of the tie plate handling device 100 enables an operator to control the operation of the lifting arm 120, the engaging unit 102 and, in those embodiments where the tie plate handling device 100 is mounted on a moveable frame 12, the speed and motion of the moveable frame 12. It will be appreciated that the control unit 140 may comprise any controlling device known in the art that is adapted for these functions.

Figure 5A:
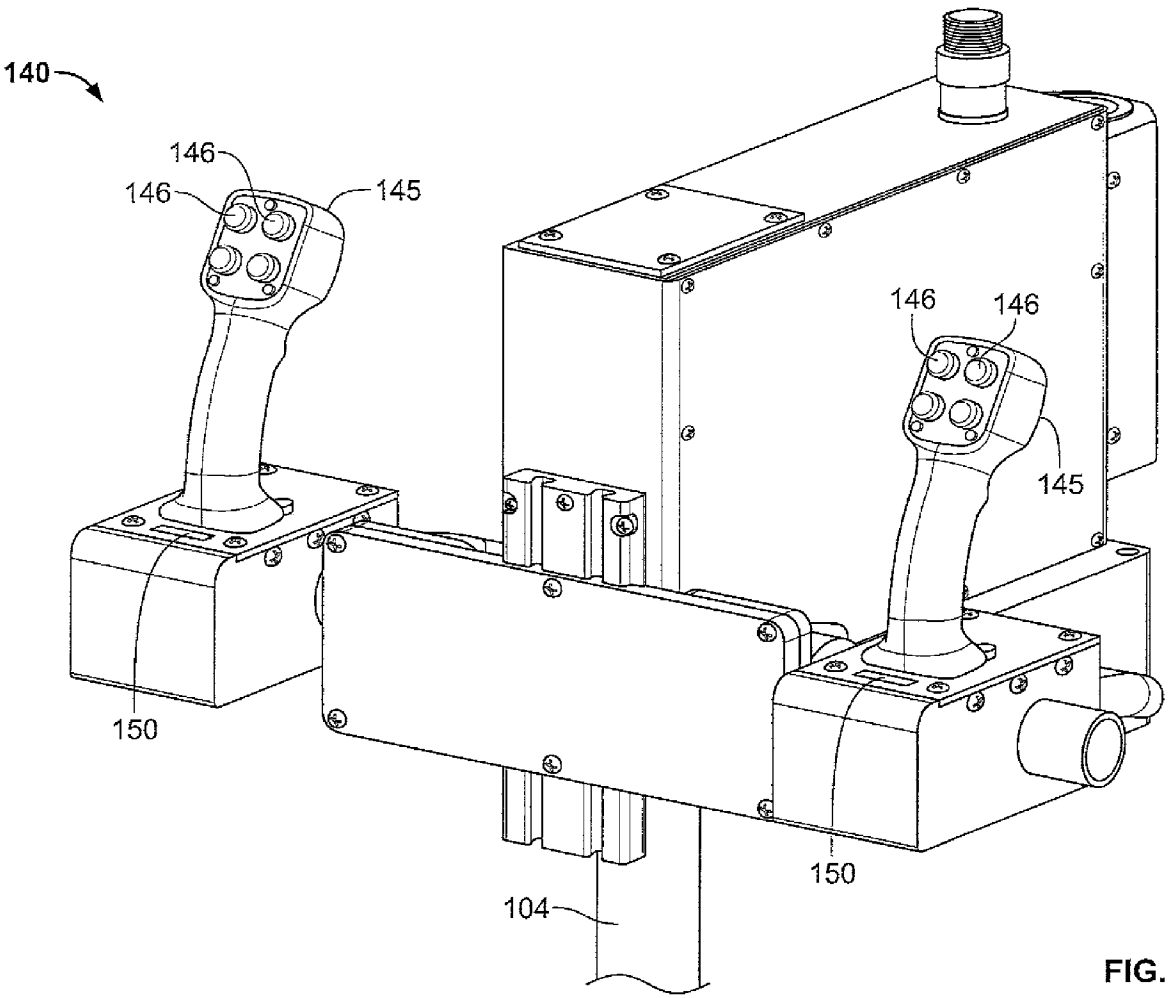
FIGS. 5A and 5B show view of at least one embodiment of a control unit of the tie plate handling device of FIG. 1A.
Figure 5B:
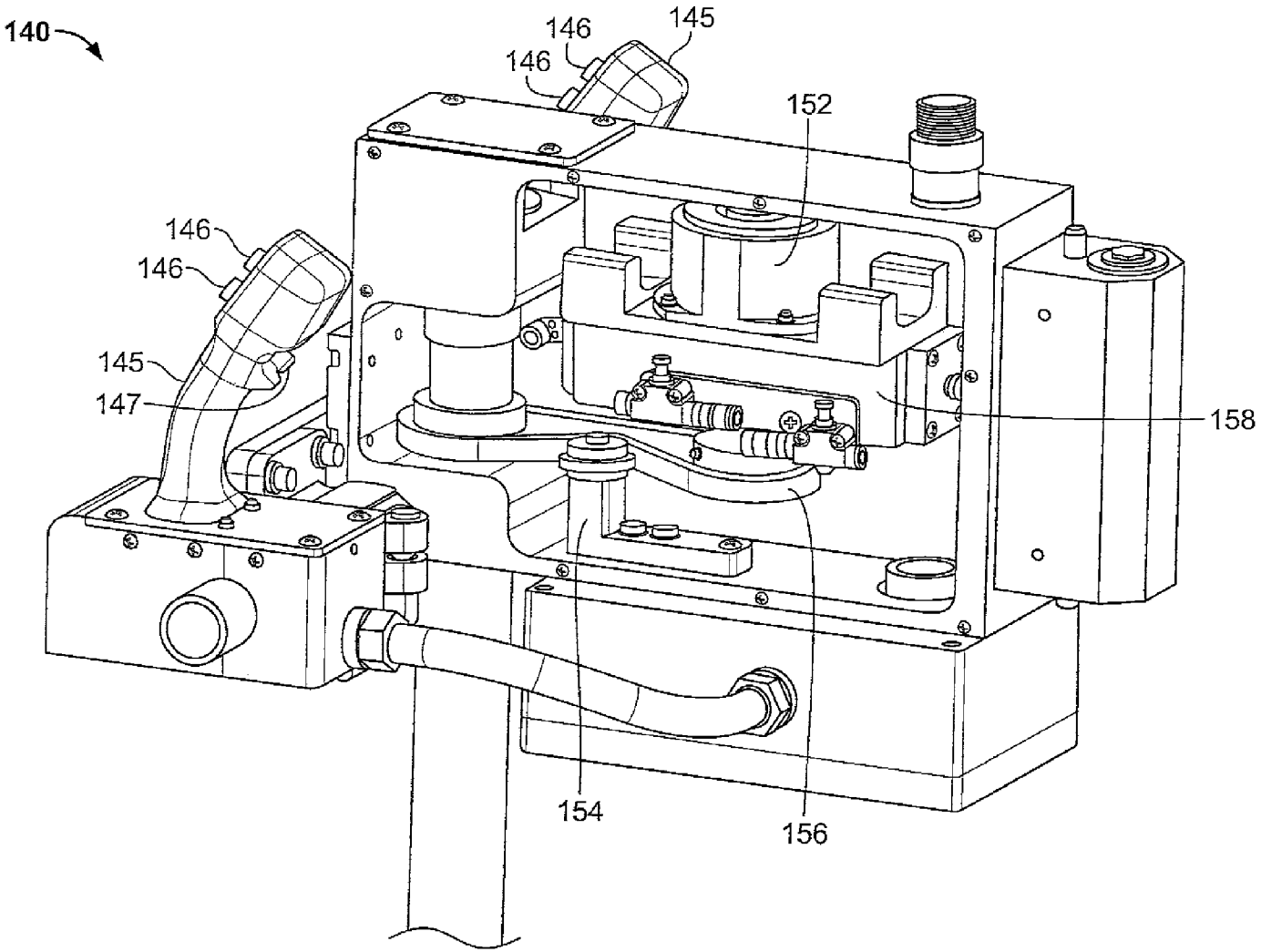

Referring now to FIGS. 5A and 5B, at least one embodiment of the control unit 140 of the tie plate handling device 100 is shown. Specifically, FIG. 5A illustrates a perspective view of the control unit 140 and FIG. 5B shows the interior and inner-workings of at least one embodiment of the control unit 140. As shown in FIG. 5B, the control unit 140 may comprise an air brake 152 for assisting an operator in maneuvering the lifting arm 120 and/or tie plate 14 coupled with the engaging unit 102 (specifically with respect to the angular rotation thereof). A belt tensioner 154, high torque drive belt with pulleys 156, and a rotary actuator 158 may also be provided for rotating the shaft 104.

The control unit 140 may additionally comprise one or more joysticks 145 through which an operator may direct the operation of the tie plate handling device 100. In at least one embodiment, a joystick 145 may comprise one or more control buttons 146 and/or a trigger 147. The button(s) 146 and/or trigger 147 may be variously adapted to enable an operator to toggle the electromagnet 108 on or off to couple with or release a tie plate, rotate the shaft 104, and/or control the motion and other aspects of the moveable frame 12 to which the tie plate handling device 100 is mounted, including in at least one embodiment actuating a horn or enunciator (not shown), such as for providing a safety alert. Furthermore, each joystick 145 may have at least one photoelectric sensor 150, or photoeye, positioned thereby to detect the presence or absence of an operator's hands and function as a dead-man switch. In this manner, if an operator removes one or both hands from the joystick(s) 145, the moveable frame 12 to which the tie plate handling device 100 is mounted will stop.

In at least one embodiment, the lifting arm 120 and engaging unit 102 are robotic and the control unit 140 of the tie plate handling device 100 is adapted for remote operation. Here, the joystick(s) 145 and other controls or interfaces of the control unit 140 are separate from the tie plate handling device 100. Accordingly, an operator may ride on the moveable frame 12 or other machine to which the tie plate handing device 100 is mounted, walk adjacent to the tie plate handing device 100 or otherwise be located apart from the tie plate handling device 100, while maintaining control of the same.

Additionally, the complete operation of the tie plate 14 removal and repair may be automated. In at least one embodiment, the robotic lifting arm 120 may be further configured to automatically remove or place tie plates 14 on cross-ties 16 pursuant to input received from one or more sensors (not shown) without any input required from an operator. In at least one embodiment, the sensor(s) are coupled with the work car 12, however, it will be appreciated that the sensor(s) may be mounted in any location on the work car 12 or tie plate handling device 100. In at least one embodiment, the one or more sensors may comprise a vision sensor adapted to receive visual data on the tie plates 14 and transmit such data to a processor (not shown). For example, in at least one embodiment, the vision sensor receives and transmits a visual display of the spatial orientation of the tie plate 14 relative to a cross-tie 16 or other targeted surface such that the processor can appropriately control the robotic lifting arm 120 and automatically remove or place the tie plate 14 on the cross-tie 16.

The processor may be a component of the control unit 140 or independent thereof, provided the processor is in wired or wireless communication with the control unit 140. Further, in at least one embodiment, the processor is programmed to process the data received from the sensor(s) pursuant to an algorithm developed for identifying each tie plate 14, identifying the origin location of each tie plate 14, and/or identifying the proper orientation of each tie plate 14 with respect to the cross-tie 16 dependent on whether the tie plate 14 is being removed from the cross-tie 16 prior to resurfacing or being placed on the cross-tie 16 after resurfacing has been completed. In this manner, after processing the data pursuant to the algorithm, the processor sends instructions to the control unit 140 such that the control unit 140 can automatically control the operation of the tie plate handling device 100 with respect to removal and replacement of the tie plates 14 on a railway 10. Furthermore, the processor may also instruct the control unit 140 with respect to advancement of the moveable frame 12 along the railway 10.

Methods for use of the tie plate handling device 100 will now be described. It will be appreciated that while such methods are described in connection with an operator 200, these methods may be adapted for use in connection with the embodiments of the tie plate handling device 100 comprising a remote control unit 140 and/or the completely automated system.

In operation, an operator 200 can use the tie plate handling device 100 to assist with moving tie plates 14 and repairing a portion of a railway 10. Now referring to FIG. 1A, in at least one embodiment, an operator 200 walks behind the tie plate handling device 100 and moveable frame 12. The operator 200 can control the advancement of the moveable frame 12 (and thus the tie plate handling device 100) through use of the control unit 140. In this manner, the operator 200 can use the control unit 140 to couple the engaging unit 102 with a tie plate 14, perform the requisite work to the underlying rail bed, replace the tie plate 14 to the resurfaced rail bed, and subsequently cause the moveable frame 12 to advance down the rail 15 to the next tie plate 14. Further, in at least one embodiment, when the moveable frame 12 travels at a speed set by the operator 200, if the operator 200 cannot keep pace, the operator 200 need only to remove either hand from the control unit 140 to stop the moveable frame 12 via the deadman device(s) 150.

Figure 6A:
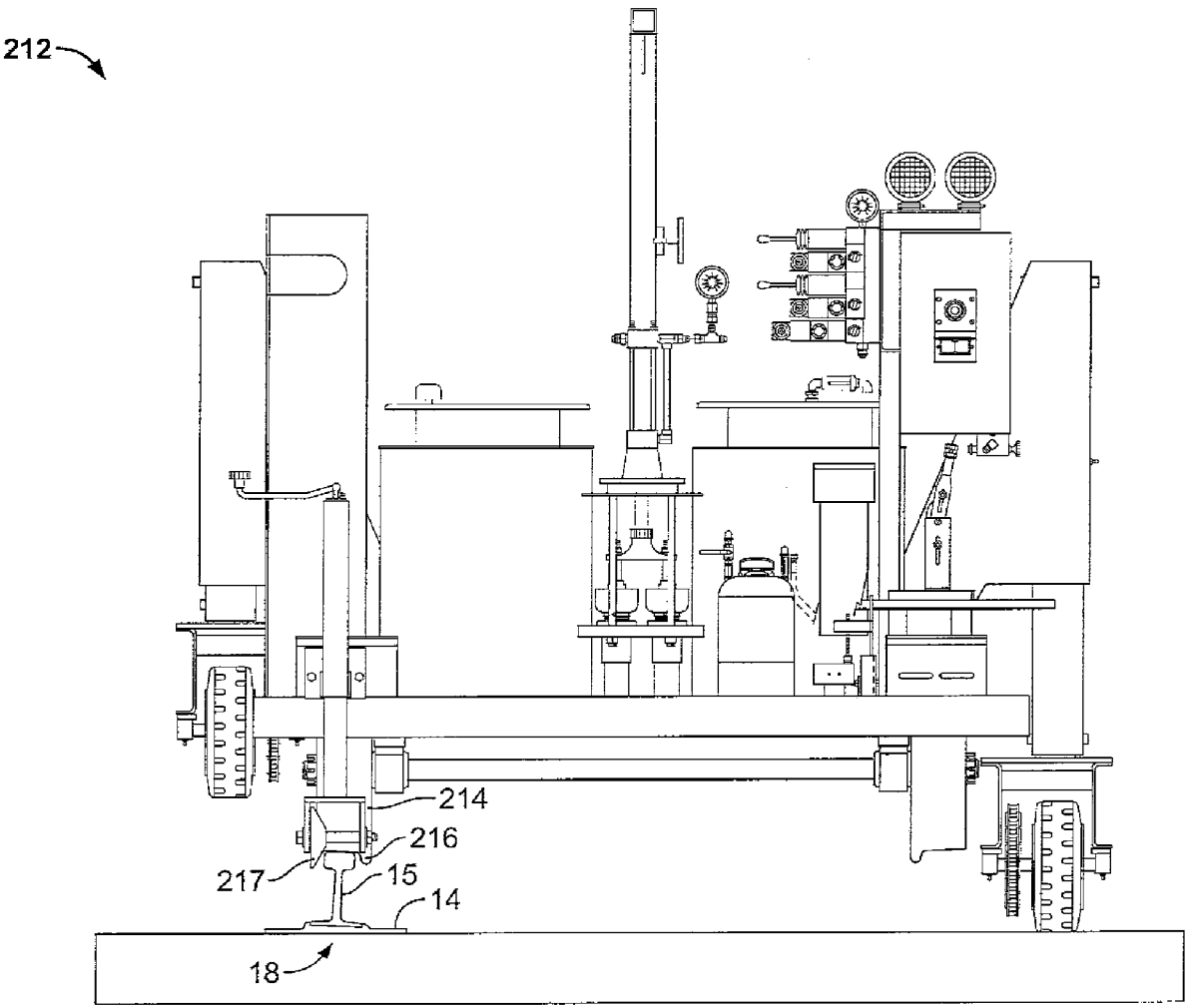
FIG. 6A shows a front view of conventional work equipment positioned on a single rail during a rail change out process.
Figure 6B:
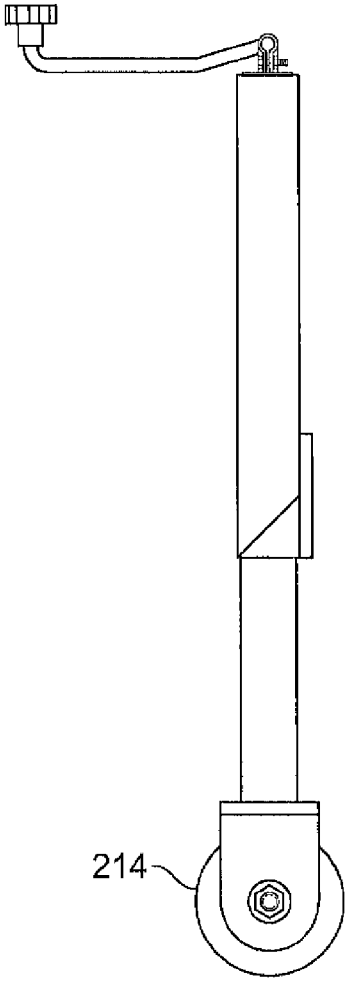
FIGS. 6B and 6C show side and front views, respectively, of the rail travel wheel component of the work equipment of FIG. 6A.
Figure 6C:
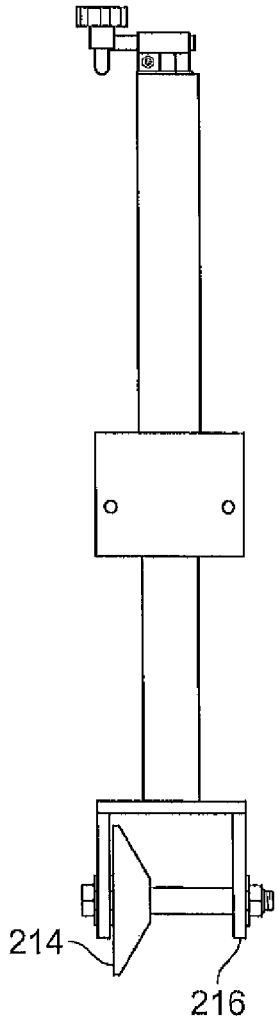

Now referring to FIGS. 6A-6C, during a rail change out process, the work equipment employed must be able to travel with only one rail 15 in place. This can be accomplished by having a deployable or moveable crawler or crawlers 212 that can be lowered to support the vehicle load on the side of the track where the rail has been removed while the vehicle is supported on and rides with rail travel wheels 214 on the remaining rail 15, As standard rail travel wheels 214 incorporate a flange 216 on their gauge side face to prevent the wheels 214 on rail bound vehicles from derailing to the field side of the track, and since this derail prevention feature is lost on the side with a removed rail, a deployable flange 217 can be used to capture the field side of the remaining rail and prevent derailment to the gauge side of the track. Accordingly, a work car or other moveable frame 12 may be securely mounted to a single rail 15 and utilized during the rail change out process in connection with the tie plate handling device 100. For example, in at least one embodiment, the moveable crawler system described in United States Patent Application Publication Number U.S. 2009/0145324 A1 to Delmonico, which is hereby incorporated by reference herein in its entirety, may be used in conjunction with the tie plate handling device 100.

Figure 7:
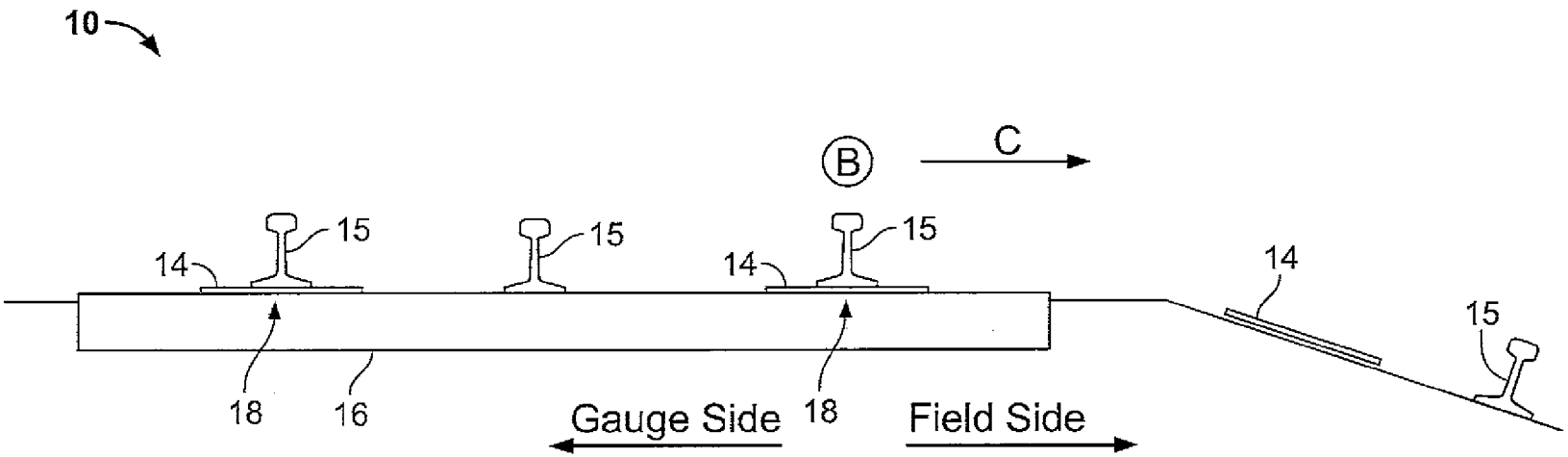
FIG. 7 shows a cross-sectional view of a railway track and the positions of the various components thereof during the rail change-out process.

Now referring to FIGS. 1A and 7, at least one embodiment of a method for using the tie plate handling device 100 is described. Primarily, in order to remove tie plates 14 from a railway 10, one of the rails 15 is first removed therefrom. As shown in FIG. 7, the rail 15 is simply moved to the field side of the track. The operator 200 then advances the moveable frame 12 a desired distance along the remaining rail 15 of the railway 10 such that the tie plate handling device 100 is positioned adjacent to the first tie plate 14 of interest.

Thereafter, the operator 200 uses the control unit 140 to maneuver the engaging unit 102 to a position B directly over the tie plate 14 in question (see FIG. 7). The engaging unit 102 is lowered and the operator 200 causes the engaging unit 102 (either through operation of the electromagnet 108 or otherwise) to engage and securely couple with the tie plate 14. After the tie plate 14 is securely coupled with the engaging unit 102, the operator operates the lifting arm 120 to easily lift the tie plate 14 and move the same to the field side of the track (see Arrow C in FIG. 7). In this manner, the now-exposed rail bearing area 18 of the cross-tie 16 can be replaced or resurfaced and other track work can be completed.

When the rail bearing area 18 of the cross-tie 16 is sufficiently repaired (for example and without limitation, the spike holes plugged and the rail bearing area 18 adzed), the operator may then maneuver the recycled tie plate 14 from the field side of the track back into position B over the rail bearing area 18. This may be accomplished through manual manipulation of the lifting arm 120 with the joystick(s) 145 or through remote means. The operator 200 can also operate the control unit 140 to rotate the shaft 104 such that the tie plate 14 is properly oriented with respect to the exposed rail bearing area 18 of the cross-tie 16. After the tie plate 14 is placed on the repaired cross-tie 16 specifically the rail bearing area 18, the operator 200 releases the tie plate 14 from the engaging unit 102 through operation of the control unit 140 (e.g., to toggle off the electromagnet 108) and the moveable frame 12 advances such that the engaging unit 102 is positioned adjacent to the next tie plate 14 and cross-tie 16 on the railway 10.

Often times during the rail change out process, the tie plates 14 removed from the existing track are to be updated to a newer design or otherwise replaced. In such instances, new tie plates 14 are added to the track. In those situations where new tie plates 14 are to be used on the cross-ties 16, the tie plate handling device 100 may be used to load a supply of new tie plates 14 onto the moveable frame 12 such that it is easily accessible during the tie plate 14 replacement process. Alternatively, the tie plate handling device 100 may be employed to load the supply of new tie plates 14 to a staged position near the track or to their ultimate location and orientation on the cross-ties 16 for subsequent operations to be conducted.

In the usual layout of a railroad steel gang, the equipment utilized in replacing rails on a railway 10 are typically positioned in a single sequence of partially rail-bound machines. Each of these machines is designed or designated for a particular task in the overall process of rail change out. It will be appreciated that while the same tie plate handling device 100 may be used to remove and replace the tie plates 14, the removal and replacement of the tie plates 14 may also be performed by separate tie plate handling devices 100, each located at a different position along the railway 10. In this manner, a first tie plate handling device 100 may be designated for removing the tie plates 14 from the cross-ties 16 and a second tie plate handling device 100, positioned at a location on the railway 10 behind the first tie plate handling device 100, may be designated for replacing the tie plates 14 to the resurfaced cross-ties 16. Alternatively or additionally, more than one tie plate handling device 100 may be mounted on the same moveable frame 12 or a separate moveable frame 12 such that each the tie plate handling device 100 is designated for a different operation.

While various embodiments of a tie plate handling device, and methods for using the same have been described in considerable detail herein, the embodiments are merely offered by way of non-limiting examples of the disclosure described herein. Many variations and modifications of the embodiments described heroin will be apparent to one of ordinary skill in the art in light of this disclosure. It will therefore be understood by those skilled in the art that various changes and modifications may be made, and equivalents may be substituted for elements thereof, without departing from the scope of the disclosure. Indeed, this disclosure is not intended to be exhaustive or to limit the scope of the disclosure. The scope of the disclosure is to be defined by the appended claims, and by their equivalents.

It is therefore intended that the disclosure will include, and this description and the appended claims will encompass, all modifications and changes apparent to those of ordinary skill in the art based on this disclosure.

What is claimed is:

1. A tie plate handling device, comprising:

a base;

an arm having a proximal end coupled to the base, and a distal end moveable vertically and laterally relative to the base; and a tie plate engaging unit coupled to the distal end of the arm for releasably engaging a tie plate, wherein the tie plate engaging unit has an engagement mechanism adapted to releasably couple with a tie plate, and wherein the tie plate engaging unit has a twin axis gimbal joint permitting angulation of the engagement mechanism.

2. The tie plate handling device of claim 1, wherein the base comprises a pedestal, and an extension pivotally coupled to the pedestal such that the extension is moveable horizontally relative to the pedestal.

3. The tie plate handling device of claim 1, wherein the arm has a joint adapted for vertical movement of the distal end of the lifting arm.

4. The tie plate handling device of claim 1, wherein the arm has first and second joints, and wherein the arm is pivotally coupled to the base at the first joint such that the arm is moveable laterally relative to the base, and the second joint is adapted for vertical movement of the distal end of the lifting arm.

5. The tie plate handling device of claim 1, wherein the engagement mechanism is selected from the group consisting of: an electromagnet, a vacuum, a clamp and combinations thereof.

6. The tie plate handling device of claim 1, wherein the tie plate engaging unit has a rotary unit for rotation of the engagement mechanism.

7. The tie plate handling device of claim 1, further comprising a control unit coupled to the lifting arm and in communication with the engaging unit, for operating the arm and the engaging unit.

8. A railroad equipment for handling a tie plate, comprising:

a frame adapted to travel on a railway; and a tie plate handling device, comprising:

a base;

an arm having a proximal end coupled to the base and a distal end moveable vertically and laterally relative to the base, wherein the arm has first and second joints, the arm pivotally coupled to the base at the first joint such that the arm is moveable laterally relative to the base, and the second joint is adapted for vertical movement of the distal end of the arm relative to the base; and a tie plate engaging unit coupled to the distal end of the arm, comprising an engagement mechanism adapted to releasably couple with a tie plate and a rotary unit for rotation of the engagement mechanism.

9. The tie plate handling device of claim 8, wherein the base comprises a pedestal, and an extension pivotally coupled to the pedestal such that the extension is moveable horizontally relative to the pedestal.

10. The tie plate handling device of claim 8, wherein the engagement mechanism is selected from the group consisting of: an electromagnet, a vacuum, a clamp and combinations thereof.

11. The tie plate handling device of claim 8, wherein the tie plate engaging unit has a joint permitting angulation of the engagement mechanism.

* * * * *